US005200289A

United States Patent [19]

Harrington et al.

[11] Patent Number: 5,200,289

[45] Date of Patent: Apr. 6, 1993

[54] CHARGE CONTROL AGENT COMBINATION FOR A LIQUID TONER

[75] Inventors: Roy J. Harrington, Waynesville; George A. Gibson, Vandalia; Margate T. Thomas, Medway, all of Ohio

[73] Assignee: AM International Incorporated, Chicago, Ill.

[21] Appl. No.: 803,478

[22] Filed: Dec. 4, 1991

[51] Int. Cl.[5] ..... G03G 9/135

[52] U.S. Cl. ..... 430/115

[58] Field of Search ..... 430/115

[56] References Cited

U.S. PATENT DOCUMENTS 3,522,181 7/1970 Garrett et al. ..... 430/115 X
3,542,682 11/1970 Mutaffis ..... 430/115
4,618,557 10/1986 Dan et al. ..... 430/114
4,762,764 8/1988 Ng et al. ..... 430/115
4,897,332 1/1990 Gibson et al. ..... 430/115

*Primary Examiner*—Roland Martin
*Attorney, Agent, or Firm*—Tarolli, Sundheim & Covell

[57] ABSTRACT

A liquid toner composition for electrophotography comprising a dispersion which includes a carrier liquid, pigmented or dyed toner particles, an inorganic binder insoluble in the carrier liquid at room temperature and a charge control agent in a charge directing amount, said charge control agent comprising lecithin, 1% to 2.5% by weight, based on the total weight of active components in the charge control agent, of an alkylated N-vinyl pyrrolidone polymer, and 0.5% to 10% by weight, based on the total weight of active components in the charge control agent, of an oil soluble or dispersible anionic surfactant.

15 Claims, 2 Drawing Sheets

CHARGE CONTROL AGENT COMBINATION FOR A LIQUID TONER

TECHNICAL FIELD

The present invention relates to liquid toner dispersions of the type used in electrophotography. The liquid toner dispersions of the present invention are particularly suitable for high speed machines. The liquid toner dispersions provide a more uniform conductivity when exposed to fast, repetitive applications of an electric field.

BACKGROUND OF THE INVENTION

A plate used in a xerographic process comprises a photoconductive layer mounted on a conductive base. The photoconductive layer is sensitized by uniformly distributing electrostatic charges, either positive or negative, over the surface of the layer. The photoconductive layer is a good insulator in the dark so that the electrostatic charges are retained on the surface. Areas of the photoconductive layer can then be illuminated, for instance by projecting an image on the layer, or by writing on the layer with a laser or light-emitting diode (LED). This causes the electrical resistance of the layer in the illuminated areas to be reduced. The charges in the illuminated areas are then dissipated to the conductive base. The non-illuminated areas remain electrostatically charged. The photoconductive layer is then developed, in a developing zone, by adhering oppositely-charged pigmented and/or dyed toner particles to the non-illuminated charged areas. This is carried out in a manner known in the art, disclosed, by way of example, in U.S. Pat. No. 5,003,352, assigned to the assignee of the present application.

The development of the photoconductive layer, in a developing zone, can be accomplished using a liquid toner. Liquid toner dispersions for electrophotography are generally prepared by dispersing pigmented or dyed toner particles, and natural or synthetic resins, in a highly insulating, low dielectric constant, carrier liquid. Charge control agents are added to aid in charging the pigmented and dyed toner particles to obtain the requisite charge distribution, and liquid toner conductivity, for proper image formation on the photoconductive layer. There are a variety of mechanisms for the production of charge on toner particles. In some, the charge control agents function as surfactants and alter the surfaces of the particles providing a preferential absorption of ions of opposite charge from those on the photoconductive layer.

One deficiency of some charge control agents is that after liquid toners comprising the charge control agents have been exposed repeatedly to the electric field of the development zone, the conductivity of the liquid toner becomes transiently depressed. The ability of the charge control agent to maintain a stable charge distribution becomes diminished. This is especially true in high speed electrophotographic processes wherein images must be transferred to sheets of paper running at high speed, such as 100–1,000 feet/minute or higher. In such processes, the exposure of the toner to the electric field of the development zone over a selected period of time, is far greater, than in, for instance, an office copier or other slow-speed machine.

Failure of the liquid toner charge control agents to maintain toner charge distribution within closely controlled limits results in poor print quality. Additionally, departure of the toner charge distribution from said limits can result in a loss of control of the concentration of components of the toner composition.

DESCRIPTION OF THE PRIOR ART

U.S. Pat. No. 4,897,332, assigned to the assignee of the present application, discloses a toner composition having improved charge control attributes. The composition comprises a carrier liquid, a pigment or dye, a binder material, and a charge control agent comprising the combination of lecithin and an alkylated N-vinyl pyrrolidone polymer. The liquid-toner composition is capable of maintaining its charge distribution within narrow, uniform ranges even during high speed electrophotography.

U.S. Pat. No. 4,762,764 discloses a liquid developer comprising an insulating organic liquid medium, negatively charged particles dispersed within the medium, and a charge control agent selected from the group consisting of polybutene succinimide, lecithin, a basic barium petroleum sulfonate, and mixtures thereof. No examples are given in the patent of mixtures of the listed charge control agents. The liquid developer is used in electrostatic imaging systems, electrographic recording, electrostatic printing, and facsimile printing. There is no reference in the patent to high speed electrostatic printing.

U.S. Pat. No. 4,618,557 discloses a liquid developer for electrostatic photography. Polarity controlling agents disclosed in the patent include polymers which may contain a metal soap, lecithin, linseed oil, a higher fatty acid, and vinyl-pyrrolidone.

SUMMARY OF THE INVENTION

The present invention resides in a liquid toner composition for electrophotography comprising a dispersion which includes a carrier liquid, pigmented or dyed toner particles, an inorganic binder which preferably is insoluble in the carrier liquid at room temperature, and a charge control agent, in a charge directing amount, said charge control agent comprising lecithin, an alkylated N-vinyl pyrrolidone polymer, and 0.5% to 10% by weight, based on the total weight of active components in the charge control agent, of an anionic oil soluble or dispersible surfactant.

A preferred alkylated N-vinyl pyrrolidone polymer is one comprised of N-vinyl pyrrolidone copolymerized with lecithin.

A preferred anionic surfactant is an oil-soluble petroleum sulfonate.

The present invention also resides in a method of creating an image by applying an electrostatic charge to the image area of a substrate, at a substrate speed of 100–1,000 feet per minute, wherein a liquid toner composition is applied to the substrate, the liquid toner composition comprising a carrier liquid, pigmented or dyed toner particles, an inorganic binder which preferably is insoluble in the carrier liquid at room temperature, and a charge control agent in a charge directing amount, said charge control agent comprising lecithin, an alkylated N-vinyl pyrrolidone polymer, and 0.5% to 10% by weight, based on the total weight of active components in the charge control agent, of an anionic oil soluble or dispersible surfactant.

A preferred alkylated N-vinyl pyrrolidone polymer in the method is one comprised of N-vinyl pyrrolidone copolymerized with lecithin.

A preferred anionic surfactant in the method is an oil-soluble petroleum sulfonate.

BRIEF DESCRIPTION OF THE DRAWINGS

The foregoing and other features of the present invention will become apparent to one skilled in the art upon consideration of the following description of the invention with reference to the accompanying drawings, wherein.

DESCRIPTION OF THE PREFERRED EMBODIMENTS

Figure 1:
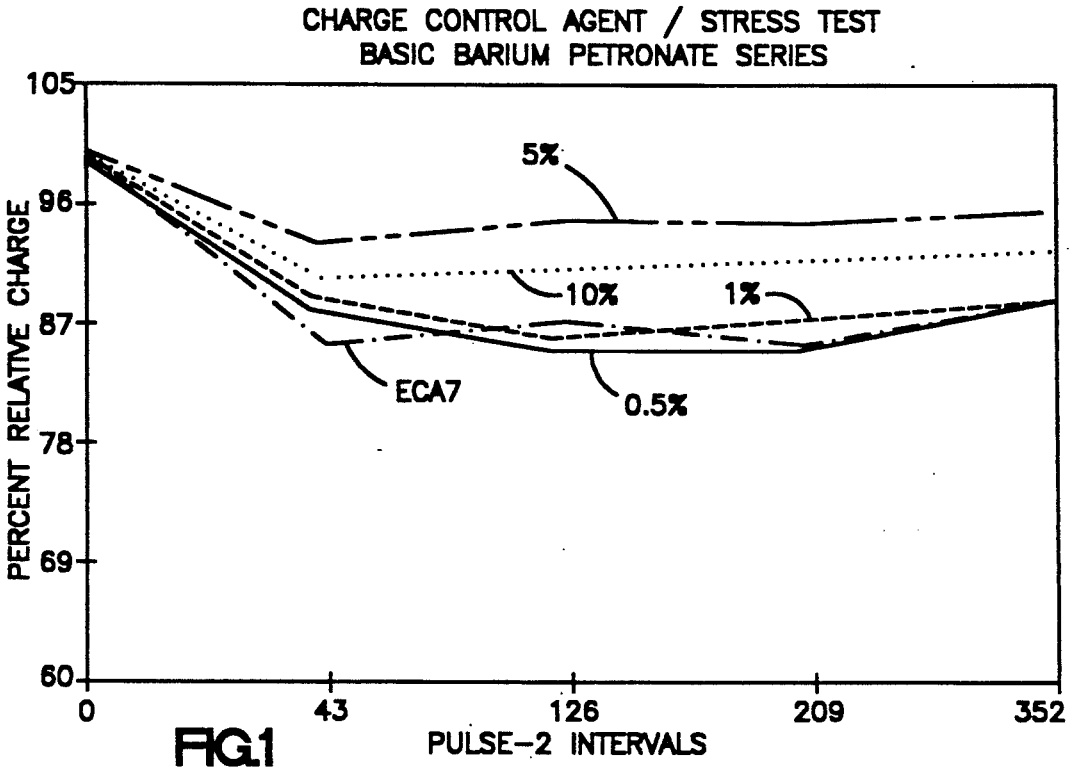
FIG. 1 is a diagram showing the effect of a surfactant, in varying amounts, in test compositions of the present invention subjected to a stress test described in Examples 1–in the present application.

The liquid toner composition of the present invention comprises a carrier liquid, pigmented or dyed toner particles, an inorganic binder which preferably is insoluble in the carrier liquid, and a charge control agent in a charge directing amount. The charge control agent comprises lecithin, an alkylated N-vinyl pyrrolidone polymer, and 0.5% to 10% by weight, based on the total weight of active components of the charge control agent, of an anionic oil soluble surfactant.

The surfactant of the present invention broadly can be any anionic surfactant which is soluble or dispersible in the carrier liquid. Two broad categories of anionic surfactants are available, metal salts of hydrophobic organic acids, and non-metal salts of hydrophobic organic acids. Examples of both categories of anionic surfactants have been successfully employed in the practice of the present invention.

Examples of salts of hydrophobic organic acids of both categories which can be employed are metal and non-metal alkyl sulfonates, metal and non-metal salts of alkyl sulfates, metal and non-metal salts of alkyl carboxylates, metal and non-metal salts of alkyl phenolates, and metal and non-metal alkylaryl salts of sulfonates, sulfates, carboxylates and phenolates. The anionic surfactants can be fluorinated or non-fluorinated. Also, in the classification of salts of hydrophobic organic acids are metal and non-metal alkyl phosphates and metal and non-metal alkylaryl phosphates.

A preferred anionic surfactant is a salt of a sulfonated petroleum product, more specifically, an oil-soluble petroleum sulfonate.

A preferred oil-soluble petroleum sulfonate is a basic alkylaryl barium sulfonate composition marketed by the Sonneborn Division of Witco Chemical Corporation under the trademark BASIC BARIUM PETRONATE. The composition comprises about 40% to 46% barium sulfonate, about 43% oil, and about 12.2% barium carbonate providing a total base number (TBN) of about 65–70. The barium sulfonate has a molecular weight of 1,100.

Another alkyaryl barium sulfonate composition that can be used is one marketed by the Sonneborn Division of Witco Chemical Corporation under the trademark NEUTRAL BARIUM PETRONATE. This composition has a total basic number (TBN) of less than five. Its molecular weight is 1,000. The composition comprises about 48.8% barium sulfonate and 49.5% oil.

Another oil-soluble petroleum sulfonate that can be used is an alkylaryl calcium sulfonate composition marketed by the Sonneborn Division of Witco Chemical Corporation under the trademark CALCIUM PETRONATE. Two grades that were successfully used are CALCIUM PETRONATE 25H which has a basicity provided by calcium hydroxide, and CALCIUM PETRONATE 25C which has a basicity provided by calcium carbonate. Both grades comprise about 43% to 46% calcium sulfonate, and have a molecular weight of about 880 and a total base number (TBN) of 21.

Also successfully used were alkyaryl sodium sulfonate compositions marketed by the Sonneborn Division of Witco Chemical Corporation under the trademarks SODIUM PETRONATE L, SODIUM PETRONATE HL, and SODIUM PETRONATE CR. These compositions have molecular weights within the following ranges, respectively, 415–430, 440–470, and 490–510. The compositions comprise approximately 32% to 33% oil and 61% to 63% sodium sulfonate.

In each of the above compositions, the active component is the sulfonate. The weight percentage of 0.5% to 10% anionic surfactant, called for in the compositions of the present invention, means 0.5% to 10% of the active component of the surfactant composition which is used, minus whatever carrier oil and base ingredient may be present in the composition.

Another suitable anionic surfactant successfully employed in the present invention is isopropylammonium dodecyl benzene sulfonate marketed as the isopropylamine salt of dodecyl benzene sulfonic acid, by Ruetgers-Nease Chemical Co., Inc., under the trademark NAXEL AAS SPECIAL 3. Another is sodium dodecyl benzene sulfonate marketed by Ruetgers-Nease Chemical Co., Inc. under the trademark NAXEL AAS-90F. Other suitable anionic surfactants include sodium stearate, magnesium stearate, sodium lauryl sulfate, and sodium oleate.

A preferred lecithin is a granular soybean lecithin extract (L-α-phosphatidyl-choline) which is available from American Lecithin Company. A soybean lecithin extract can also be obtained from Sigma Chemical, St. Louis, Mo. Other lecithin extracts can also be used such as an egg yolk extract and a bovine brain extract, also available from Sigma Chemical.

Preferably, the charge control agent of the present invention also comprises an alkylated N-vinyl pyrrolidone polymer which is soluble in the carrier liquid.

A preferred alkylated N-vinyl pyrrolidone polymer is prepared by reacting poly-N-vinyl pyrrolidone with lecithin. The reaction can be carried out in a glass reactor having a mechanical stirring device and a reflux condenser. By way of example, the glass reactor can be charged with 8.4 kg of ISOPAR H (Exxon Chemical Co., Inc.) and 3.6 kg of soybean lecithin from American Lecithin Company. The reactants are kept under a nitrogen atmosphere and heated to 196° F. The lecithin dissolves at about that temperature. The reactor is then charged with 0.611 kg of N-vinyl pyrrolidone (from BASF) and 0.020 kg of 2,2'-Azobis (2-methyl-propionitrile). The mixture is allowed to stir for 48 hours.

The alkylated N-vinyl pyrrolidone polymers may also be prepared by reacting poly-N-vinyl pyrrolidone with an olefin in the presence of an organic peroxide catalyst at elevated temperatures. Details of this reaction may be gleaned from U.S. Pat. No. 3,417,054 (Merijan et al.), the disclosure of which is incorporated by reference herein. The α-olefin preferably has from about 12–20 carbon atoms. For example, doecene-1, tetradecene-1, hexadecene-1, heptadecene-1, octadecene-1, nonadecene-1, and eicosene-1, can be used. Further, low molecular weight polybutenes may also be used in the alkylation step. It is also possible for the various olefins to be reacted in a mixture.

Also, the pyrrolidone polymer can be an alkylated poly-N-vinyl pyrrolidone which is commercially available from G.A.F. Corporation under the trademark "GANEX V-216". It is poly(vinyl pyrrolidone/1-hexadecene) homopolymer having a molecular weight of about 7300. Molecular weight is not critical as long as the resulting polymer is soluble in the carrier liquid of the toner of the present invention.

Preferably, the charge control agent of the present invention comprises lecithin and an alkylated N-vinyl pyrrolidone polymer in the weight ratio (of active components) of from 1:9 to 9:1 lecithin to polymer. A preferred weight ratio range is from 1:1 (lecithin to polymer) to 1:9 with an especially preferred range being from about 3:7 to 1:9 lecithin to polymer. If the alkylated N-vinyl pyrrolidone polymer contains lecithin in the polymer backbone, as in the preferred example above, then the amount of lecithin in the polymer backbone is included in the calculation of lecithin to polymer ratio.

As a carrier liquid for the liquid toner dispersions of the invention, those having an electric resistance of at least $10^9$O cm and a dielectric constant of not more than 3.5 are particularly useful. Exemplary carrier liquids include straight-chain or branched-chain aliphatic hydrocarbons and the halogen substitution products thereof. Examples of these materials include octane, isooctane, decane, isodecane, decalin, nonane, dodecane, isododecane, etc. Such materials are sold commercially by Exxon Co. under the trademarks: ISOPAR®-G, ISOPAR®-H, ISOPAR®-K, ISOPAR®-L, ISOPAR®-V. These particular hydrocarbon liquids are narrow cuts of isoparaffinic hydrocarbon fractions with high levels of purity. High purity paraffinic liquids such as the Norpar series of products sold by Exxon may also be used. These materials may be used singly or in combination. It is presently preferred to use Isopar®-H.

The dyed or pigmented particles that are used are well known. For instance, carbon blacks such as channel black, furnace black or lamp black may be employed in the preparation of black developers. One particularly preferred carbon black is MOGUL L (trademark) from Cabot. Organic pigments, such as Phthalocyanine Blue (C.I. No. 74 160), Phthalocyanine Green (C.I. No. 74 260 or 42 040), Sky Blue (C.I. No. 42 780), Rhodamine (C.I. No. 45 170), Malachite Green (C.I. No. 42 000), Methyl Violet (C.I. 42 535), Peacock Blue (C.I. No. 42 090) Naphthol Green B (C.I. No. 10 020), Naphthol Green Y (C.I. No. 10 006), Naphthol Yellow S (C.I. No. 10 316), Permanent Red 4R (C.I. No. 12 370), Brilliant Fast Pink (C.I. No. 15 865 or 16 105), Hansa Yellow (C.I. No. 11 725), Benzidine Yellow (C.I. No. 21 100), Lithol Red (C.I. No. 15 630), Lake Red D (C.I. No. 15 500), Brilliant Carmine 6B (C.I. No. 15 500), Permanent Red F5R (C.I. No. 12 335) and Pigment Pink 3B (C.I. No. 16 015), are also suitable. Inorganic Pigments, for example Berlin Blue (C.I. No. Pigment Blue 27), are also useful.

Additionally, magnetic metal oxides such as iron oxide and iron oxide/magnetites may be used.

Preferably, the pigmented or dyed particles have an average particle size in the range of 0.1 to 10 microns.

As is known in the art, binders are used in liquid toner dispersions to fix the pigment particles to the desired support medium such as paper, plastic film, etc., and to aid in the particle charge. These binders may comprise thermoplastic resins or polymers such as ethylene vinyl acetate (EVA) copolymers (ELVAX® resins, DuPont), varied copolymers of ethylene and an α, β-ethylenically unsaturated acid including (meth) acrylic acid and lower alkyl ($C_1$–$C_5$) esters thereof. Copolymers of ethylene and polystyrene, and isostatic polypropylene (crystalline) may also be used. Both natural and synthetic wax materials may also be used. The above binders are insoluble in the carrier liquid at room temperature, although soluble binders can also be used.

| Preferred Liquid Toner Compositions of the Present Invention Include | |
|---|---|
| Carrier Liquid | |
| non-volatiles (solids) | 0.5–20 wt % (based on total weight of carrier liquid) - preferred 2%–4% |
| Color Imparting Particles | |
| pigments or dyes | 0–50 wt % (based on total weight solids) |
| binder (resin, polymer, or wax) | 30–99 wt % (based on total weight solids) |
| charge control agents | $1 \times 10^{-4}$–20% (active ingredient based on total weight of carrier liquid) |

In use, the liquid toner dispersions of the present invention are applied to an electrostatically charged substrate in the image areas thereof. The liquid toner dispersions are especially well adapted for use in high speed electrophotographic printing operations wherein the paper, to which image transfer from the substrate is made, may travel at speeds of from 100–1,000 feet/min., preferably from 200 feet/min. to 400 feet/min. This type of machine is disclosed in U.S. Pat. No. 5,003,352, assigned to the assignee of the present application. The disclosure of this patent is incorporated herein by reference. However, the invention is not solely adapted for use in such high speed printing operations and can also be successfully used for normal office electrostatic copiers such as the type described in U.S. Pat. No. 4,325,627 (Swidler et al.).

The following Examples illustrate the present invention.

EXAMPLES 1–4

The charge control agents of the present invention were tested against a lecithin-based charge control agent identified as ECA7. The charge control agents were subjected to an electrical stress test under conditions designed to simulate an extended use of toner compositions containing the agents. An electrolytic cell was provided. Dilute solutions consisting of $5 \times 10^{-4}$ weight percent charge control agent in ISOPAR-H were placed in the cell. Five consecutive 1,500 volt pulses each of one second duration were applied to the cell, with variable rest intervals between the pulses. The pulses were at the following intervals: zero seconds, 43 seconds, 126 seconds, 209 seconds, and 352 seconds. The current passing through the cell was recorded for each pulse and plotted against time. The current observed for the first pulse was taken to be 100% and the current observed for successive pulses was expressed as a percentage of the first pulse value. This provided a measurement of the ability of the composition to recover its capacity to conduct a charge in successive pulses, in essence a measurement of the stability of the composition.

The composition of the control ECA7 was N-vinyl pyrrolidone polymer prepared by reacting poly-N-vinyl pyrrolidone with lecithin as described above. The weight ratio of lecithin to polymer (on an active ingredient basis) was about 1:1.

In each of the Examples 1–4, several compositions were tested. The compositions were prepared by adding varying weight amounts of a surfactant to an amount of the control ECA7. The weight percentages of surfactant given in the Examples are weight of surfactant added divided by the total weight of the composition (surfactant plus control ECA-7). All weights are weight of active ingredient only. The surfactants added were as follows:

TABLE 1

| Example | Surfactant | Amount added % | | | | | |
|---|---|---|---|---|---|---|---|
| 1. | "Basic Barium Petronate" (TM) | 0.5 | 1.0 | | | 5.0 | 10 |
| 2. | Sodium Dodecyl Benzene Sulfonate | 0.5 | 1.0 | | 3.0 | 5.0 | 10 |
| 3. | "Sodium Petronate L" (TM) | 0.5 | 1.0 | | | 5.0 | 10 |
| 4. | Isopropylammonium Dodecyl Benzene Sulfonate | 0.5 | 1.0 | 2.0 | 3.0 | 5.0 | 10 |

The results obtained are shown in FIGS. 1–4.

Example 1, FIG. 1—The control ECA7 at the second pulse showed a current drop to about 87% of the initial current. The current remained low through the remainder of the test. The current was maintained at above 90% by the addition of 5% and 10% BASIC BARIUM PETRONATE (trademark).

Figure 2:
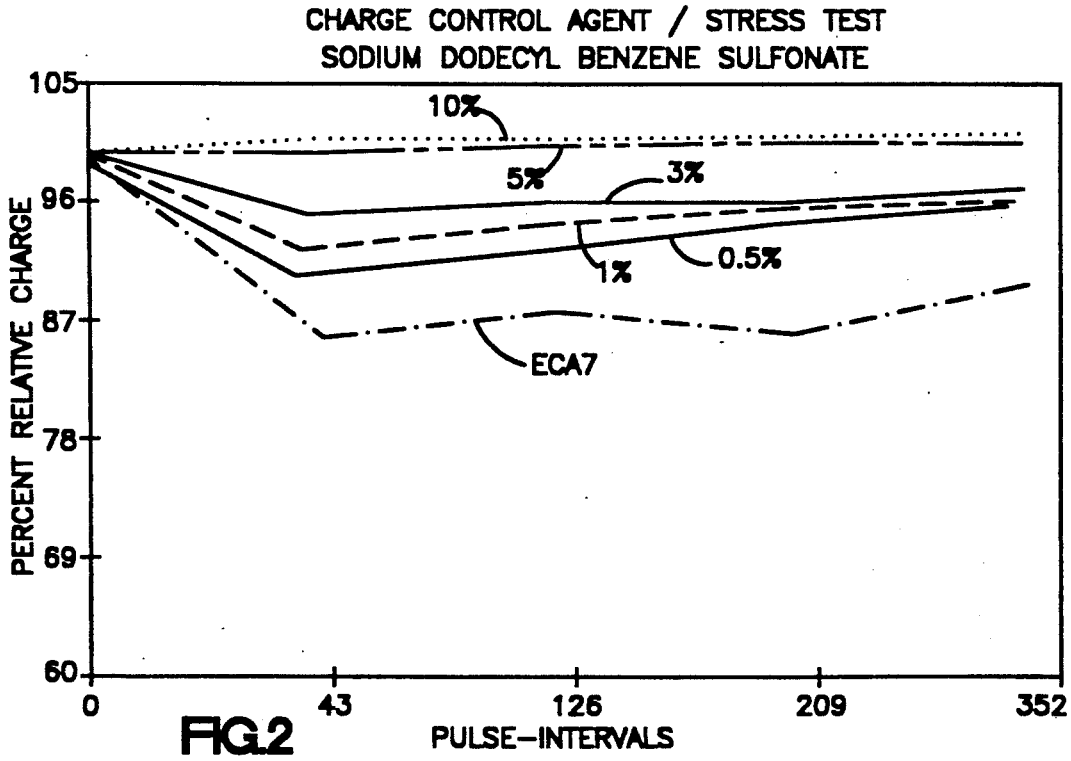
FIG. 2 is a diagram showing the effect of another surfactant, in varying amounts, in test compositions of the present invention subjected to the same stress test as used in obtaining the data of FIG. 1.

Example 2, FIG. 2—The control ECA7 at the second pulse showed a current drop to about 86% of the initial current. The current remained low for the remainder of the test. The current was maintained at above about 95% by the addition of 3% sodium dodecyl benzene sulfonate. The current was maintained at near 100% by the addition of 5% and 10% sodium dodecyl benzene sulfonate.

Figure 3:
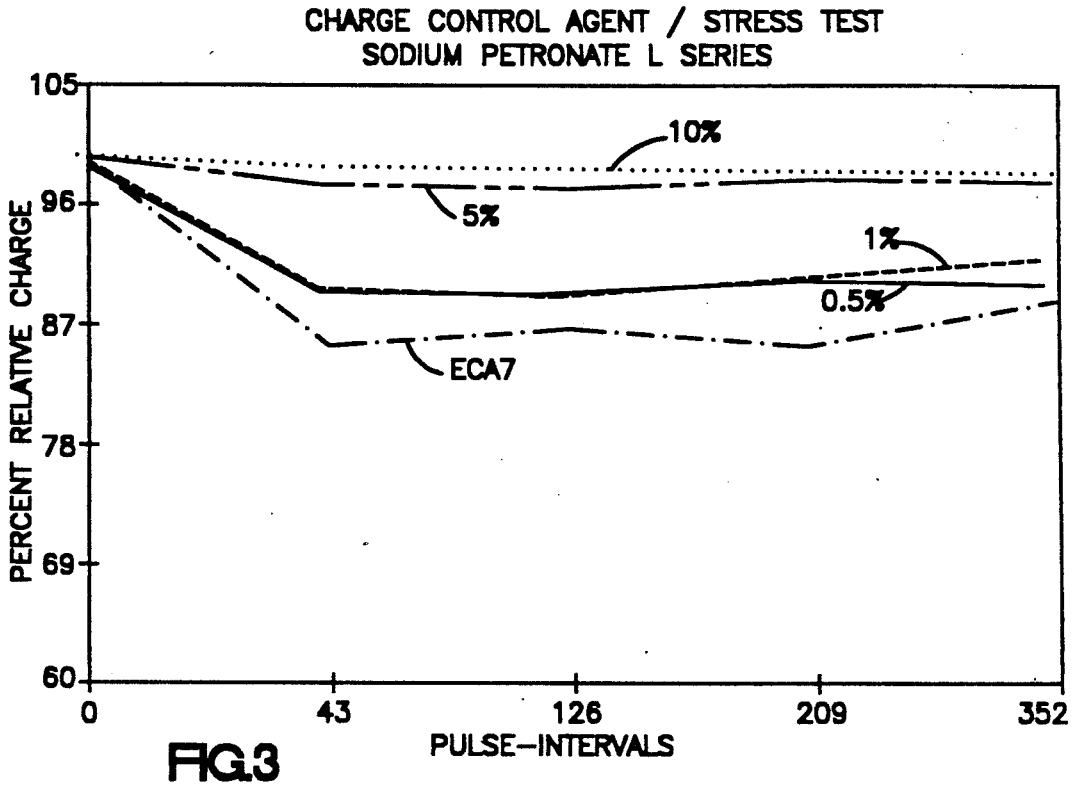
FIG. 3 is a diagram showing the effect of still another surfactant, in varying amounts, in test compositions of the present invention subjected to the same stress test as used in obtaining the data of FIG. 1.

Example 3, FIG. 3—The control ECA7 at the second pulse showed a current drop to about 87% of the initial current. The current remained low through the remainder of the test. The current was maintained at near 100% by the addition of 5% and 10% SODIUM PETRONATE L (trademark).

Figure 4:
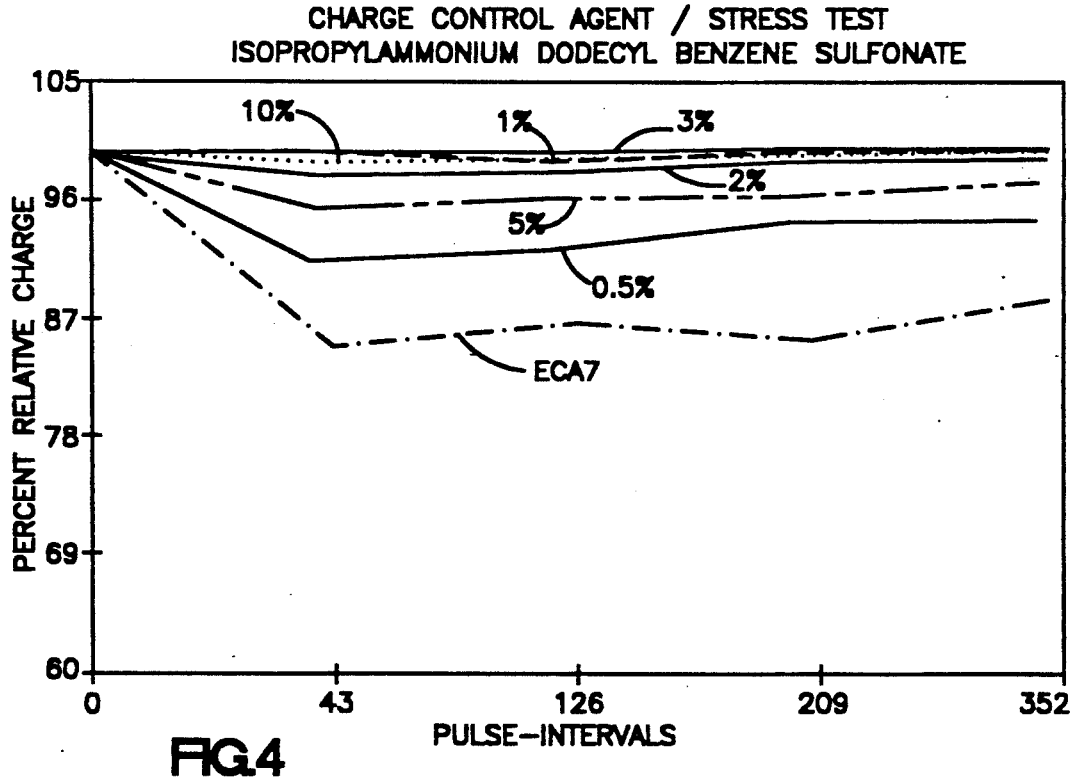
FIG. 4 is a diagram showing the effect of another surfactant, in varying amounts, in test compositions of the present invention subjected to the same stress test as used in obtaining the data of FIG. 1.

Example 4, FIG. 4—The control ECA7 at the second pulse showed a current drop to about 87% of the initial current. The current remained low for the rest of the test. The current was maintained at about 95% by the addition of 0.5% isopropylammonium dodecyl benzene sulfonate, above 96% by the addition of 5% and at near 100% by the addition of 1%, 2%, 3%, and 10%, respectively.

The surfactant added in all of the Examples was an anionic surfactant. The above Examples show that the addition of 0.5%–10% of an anionic surfactant to a lecithin containing charge control agent achieved a substantial improvement in charge stability.

From the above description of the invention, those skilled in the art will perceive improvements, changes and modifications. Such improvements, changes and modifications within the skill of the art are intended to be covered by the appended claims.

Having described the invention, the following is claimed:

1. A liquid toner composition for electrophotography in the form of a dispersion comprising:

(a) a carrier liquid;

(b) pigmented or dyed particles;

(c) a binder material insoluble in said carrier liquid;

(d) a charge control agent in a charge directing amount;

(e) said charge control agent comprising, lecithin, an alkylated N-vinyl pyrrolidone polymer which is soluble in the carrier liquid, and 0.5% to 10% by weight, based on the total weight of active components of the charge control agent, of an oil soluble or dispersible anionic surfactant.

2. The toner composition of claim 1 wherein said polymer is comprised of N-vinyl pyrrolidone copolymerized with lecithin.

3. The toner composition of claim 2 wherein said surfactant is metal or non-metal salt of a hydrophobic acid.

4. The toner composition of claim 3 wherein said surfactant is an oil soluble petroleum sulfonate.

5. The toner composition of claim 4 wherein said surfactant is basic barium sulfonate.

6. The toner composition of claim 5 wherein the ratio of lecithin to alkylated N-vinyl pyrrolidone polymer, on an active ingredient basis, is in the range of 1:1 to 1:9.

7. The toner composition of claim 1 wherein said pigmented or dyed particles have an average particle size within the range of 0.1 to 10 microns.

8. A method of creating an image on a substrate by electrophotography, comprising the steps of:

(a) supplying said substrate having an image area;

(b) advancing said substrate at a speed of 100–1,000 feet/minute;

(c) applying an electrostatic charge to the image area of said substrate to form a latent electrostatic image; and (d) developing said image by applying to said substrate image area a liquid toner composition comprising:

(1) a carrier liquid;

(2) pigmented or dyed particles;

(3) a binder;

(4) a charge control agent in a charge directing amount;

(5) said charge control agent comprising, lecithin an alkylated N-vinyl pyrrolidone polymer, which is soluble in the carrier liquid, and 0.5% to 10% by weight, based on the total weight of active components of the charge control agent, of an oil soluble or dispersible anionic surfactant.

9. The method of claim 8 wherein said polymer is comprised of N-vinyl pyrrolidone copolymerized with lecithin.

10. The method of claim 9 wherein said surfactant is metal or non-metal salt of a hydrophobic acid.

11. The method of claim 10 wherein said surfactant is an oil soluble petroleum sulfonate.

12. The method of claim 11 wherein said surfactant is basic barium sulfonate.

13. The method of claim 12 wherein the ratio of lecithin to alkylated N-vinyl pyrrolidone polymer, on an active ingredient basis, is in the range of 1:1 to 1:9.

14. The method of claim 8 wherein said pigmented or dyed particles have an average particle size within the range of 0.1 to 10 microns.

15. A method of creating an image on a substrate comprising the steps of:

(a) supplying said substrate having an image area;

(b) advancing said substrate at a speed of 100–1,000 feet/minute;

(c) applying an electrostatic charge to the image area of said substrate to form a latent electrostatic image; and (d) developing said image by applying to said substrate image area the liquid toner composition of claim 1.

* * * * *